US009949559B2

(12) United States Patent
Rosenblum et al.

(10) Patent No.: US 9,949,559 B2
(45) Date of Patent: Apr. 24, 2018

(54) RX LABEL DEFACEMENT DEVICE

(71) Applicants: Richard Rosenblum, Port Murray, NJ (US); Jennifer Rosenblum, Port Murray, NJ (US); Jonathan Rosenblum, Port Murray, NJ (US)

(72) Inventors: Richard Rosenblum, Port Murray, NJ (US); Jennifer Rosenblum, Port Murray, NJ (US); Jonathan Rosenblum, Port Murray, NJ (US)

( * ) Notice: Subject to any disclaimer, the term of this patent is extended or adjusted under 35 U.S.C. 154(b) by 266 days.

(21) Appl. No.: 14/701,834

(22) Filed: May 1, 2015

(65) Prior Publication Data

US 2015/0327661 A1 Nov. 19, 2015

Related U.S. Application Data

(60) Provisional application No. 62/000,153, filed on May 19, 2014.

(51) Int. Cl.

| | |
|---|---|
| ***A46B 9/02*** | (2006.01) |
| ***B24B 23/08*** | (2006.01) |
| ***A46B 15/00*** | (2006.01) |

(52) U.S. Cl.

CPC ..... *A46B 9/02* (2013.01); *A46B 15/0081* (2013.01); *A46B 2200/3013* (2013.01)

(58) Field of Classification Search

CPC ..... A46B 9/02; B24B 23/00; B24B 23/08; B24D 15/04; B24D 15/02; B24D 15/00

USPC ..... 451/555, 557, 558, 484–486, 523–525, 451/439

See application file for complete search history.

(56) References Cited

U.S. PATENT DOCUMENTS

| | | | | |
|---|---|---|---|---|
| 647,676 | A | 4/1900 | Laverack | |
| 2,405,680 | A | 8/1946 | Williams | |
| 2,922,218 | A * | 1/1960 | Lewis | B08B 9/021 131/246 |
| 3,745,622 | A * | 7/1973 | DeAmicis | B23D 71/00 15/104.011 |
| 4,056,863 | A | 11/1977 | Gunjian | |
| 4,365,380 | A | 12/1982 | Fassler | |
| 5,146,717 | A * | 9/1992 | Shemesh | B24D 15/026 15/104.04 |
| 5,168,660 | A | 12/1992 | Smith | |
| 5,295,278 | A * | 3/1994 | Condon | A46B 5/0012 15/104.04 |
| 5,319,823 | A | 6/1994 | Baum | |
| 5,718,030 | A * | 2/1998 | Langmack | B08B 9/083 15/63 |
| 7,959,096 | B1 * | 6/2011 | Wells, Sr. | B02C 19/0075 241/100 |
| 8,162,024 | B2 | 4/2012 | Pierce | |
| 8,459,578 | B1 | 6/2013 | Fischer | |
| 2008/0098604 | A1 * | 5/2008 | Levi | B24D 15/00 30/155 |
| 2009/0007737 | A1 * | 1/2009 | Pierce | B08B 9/083 83/15 |
| 2012/0227198 | A1 | 9/2012 | Blaszczec | |
| 2013/0087170 | A1 | 4/2013 | Krouglicof | |
| 2014/0273770 | A1 | 9/2014 | McHugh | |

* cited by examiner

*Primary Examiner* — Robert Rose
(74) *Attorney, Agent, or Firm* — Lyman Smith

(57) ABSTRACT

The present invention is a hand-held device for obliterating personal medical information printed on a prescription-labeled bottle. The innovative concept scarifies the label with an abrasive surface to render the printing unreadable.

20 Claims, 6 Drawing Sheets

RX LABEL DEFACEMENT DEVICE

CROSS-REFERENCE TO RELATED APPLICATIONS

This is a U.S. Non-Provisional Patent Application claiming priority to U.S. Provisional Application 62/000,153, filed May 19, 2014.

FIELD OF THE INVENTION

This invention relates to label removal devices, and more particularly to tools for removing information from prescription labels.

BACKGROUND OF THE INVENTION

One of the fastest growing types of identity theft in the US is Medical Identity Theft (MIT) of personal health information. Like traditional identity theft, MIT costs consumers hundreds of millions of dollars annually; but unlike traditional identity theft, MIT can potentially result in harm to a person's health.

MIT can occur at interfaces such as the doctor's office, the pharmacy, the healthcare insurer, the delivery carrier and even through the internet. Most of these services provide the consumer with little or no control over how their private medical information is displayed on documents and labels.

Access for MIT is as near as a victim's own trash. Most people are casual about their trash, although some, increasingly more, shred financial documents to avoid "dumpster divers" from stealing personal identity information. Ironically, however, most people do not think of their RX bottle as a source of personal information, and one's medical prescription bottles are not typically shred-able.

The data contained on a prescription-labeled bottle sometimes includes, in addition to the patient's name, the patient's address, type of medication prescribed, doctor's name, and pharmacy name, address and phone. The data also includes the number of refills available. The name of the drug printed on the label reveals the disease or condition being treated, which is regarded as highly sensitive personal information for many.

While a medical ID thief can obtain or pay for health care treatment and medications using another's medical information, the health record relied upon for repeat or chronic treatment can also be corrupted. The result could be devastating in more than a financial way. Delivery of critical, or life-sustaining, medications to one could be compromised by the false records created by another. Unexpectedly used up refills and terminated medical insurance could cause a victim inconvenience at best and loss of critical service at worst.

The Health Insurance Portability and Accountability Act (HIPAA) Privacy Rule in the US requires "covered entities" to safeguard protected health information (PHI). This includes prohibitions regarding the disposal of prescription-labeled bottles. Thus, the problem of removing PHI from refuse is not just a domestic problem but extends into the public domains of pharmacy and hospital.

The prior art field dealing with expunging medical information treats the problem on more of an institutional scale rather than one appropriate to a home or professional office. U.S. Pat. No. 8,459,578 to Fischer, for example, discloses a label peeling apparatus which includes a motor, gears, linkage arms and a table-mounted housing. The unfulfilled need is for a small hand-held tool for individual use.

SUMMARY OF THE INVENTION

It is difficult to strip an adhesively-applied prescription label from a pharmacy bottle. The label is intentionally fixed with permanency in mind, and attempts to peel it invariably result in residual readable fragments of the label. In some cases, the label is over-taped to assure its security on the bottle. Crushing the bottle, as an alternative, rarely obliterates the information printed on it; and, as mentioned above, shredding the bottle is not a practical option at home. It is more effective, therefore, to deface the label information than to try to remove the label by scraping it off or attacking the adhesive binder.

It is an object of the present invention, therefore, to provide a hand-held device for scarifying sensitive prescription label information on medication containers rendering the information thereby unreadable. It is a further object that the hand-held device abrade the label with an abrasive surface to essentially destroy the printed substrate. It is a further object that the applied abrasive force be within the limited capability of senior users. It is a further object that the device be portable and easily stored where prescription medicine is used in the home or office. It is a further object that the operation of the device be intuitively self-evident. It is a further object that the device be inexpensive to make and simple to use.

These objects, and others to become hereinafter apparent, are embodied in a device for removing printed information from a prescription label on a container comprising an abrasive surface having a support member. The device also comprises a pressure application means for applying hand-pressure through the support member to the abrasive surface while moving the same against the prescription label. The device enables the printed information to be obliterated by scarifying the label with the abrasive surface. In a preferred embodiment, the pressure application means comprises a flexible collar rotationally disposed about the circumference of the container. In a particularly preferred instance, the abrasive surface is comprised of wire bristles.

In an alternate embodiment, a method of removing printed information from a prescription label on a container comprises the steps of providing the device described above; applying pressure by hand through the pressure application means; and scarifying the label by moving the device and the container relative to each other, wherein one hand holds and the other manipulates. In other alternate embodiments, a handle is provided to assist in manipulating the device.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION OF THE PREFERRED EMBODIMENT

Throughout the description and the claims, the term "scarify" will be taken to include the terms "abrade", "lacerate", "tear", "deface", and "delaminate"; or any such term of similar connotation; and will otherwise be taken to connote any action undertaken to render print unrecognizable through the destruction of its substrate surface.

Figure 1:
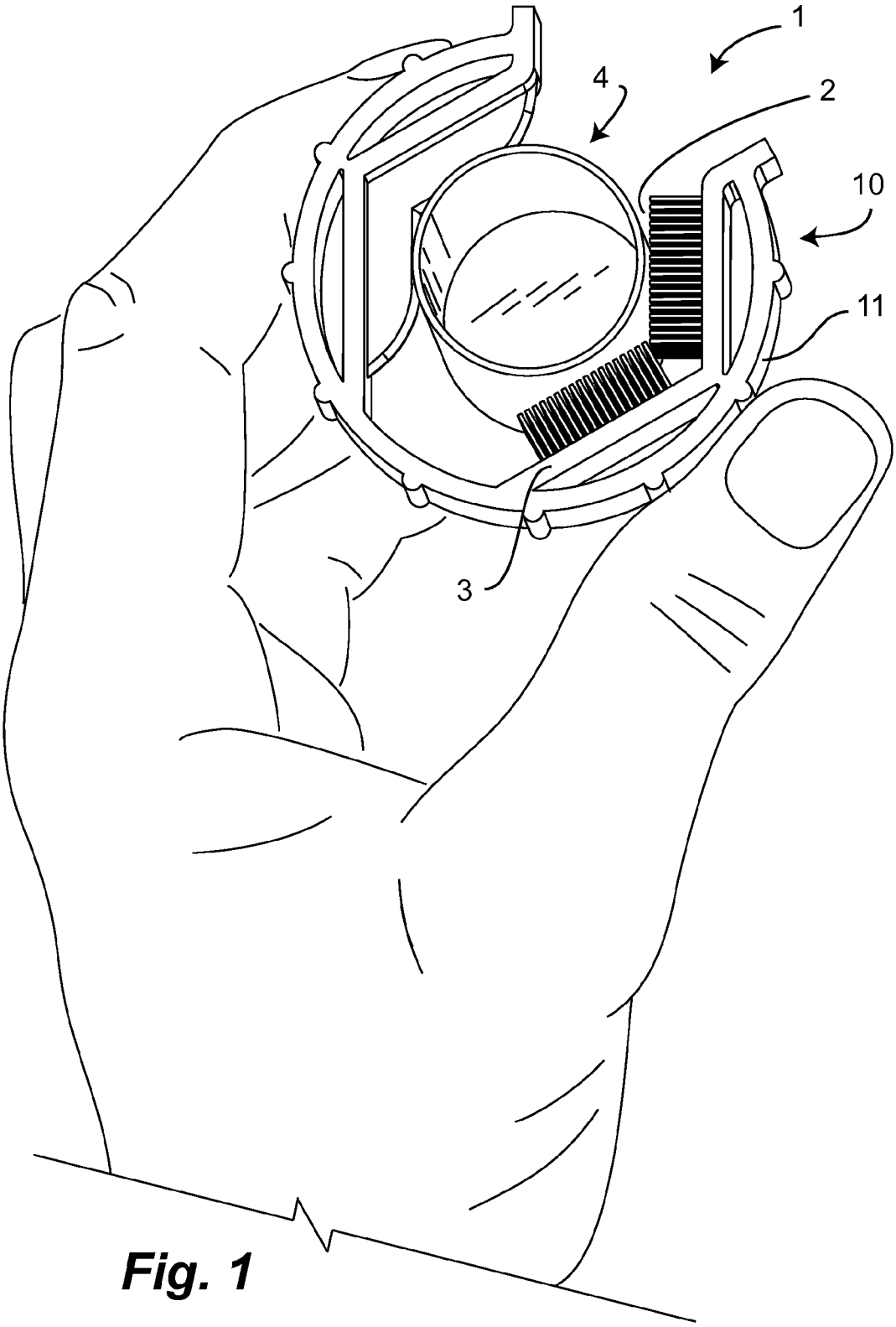
FIG. 1 is a perspective view of the preferred embodiment of the invention, showing a hand position and relative size with respect to an adult hand.
Figure 2:
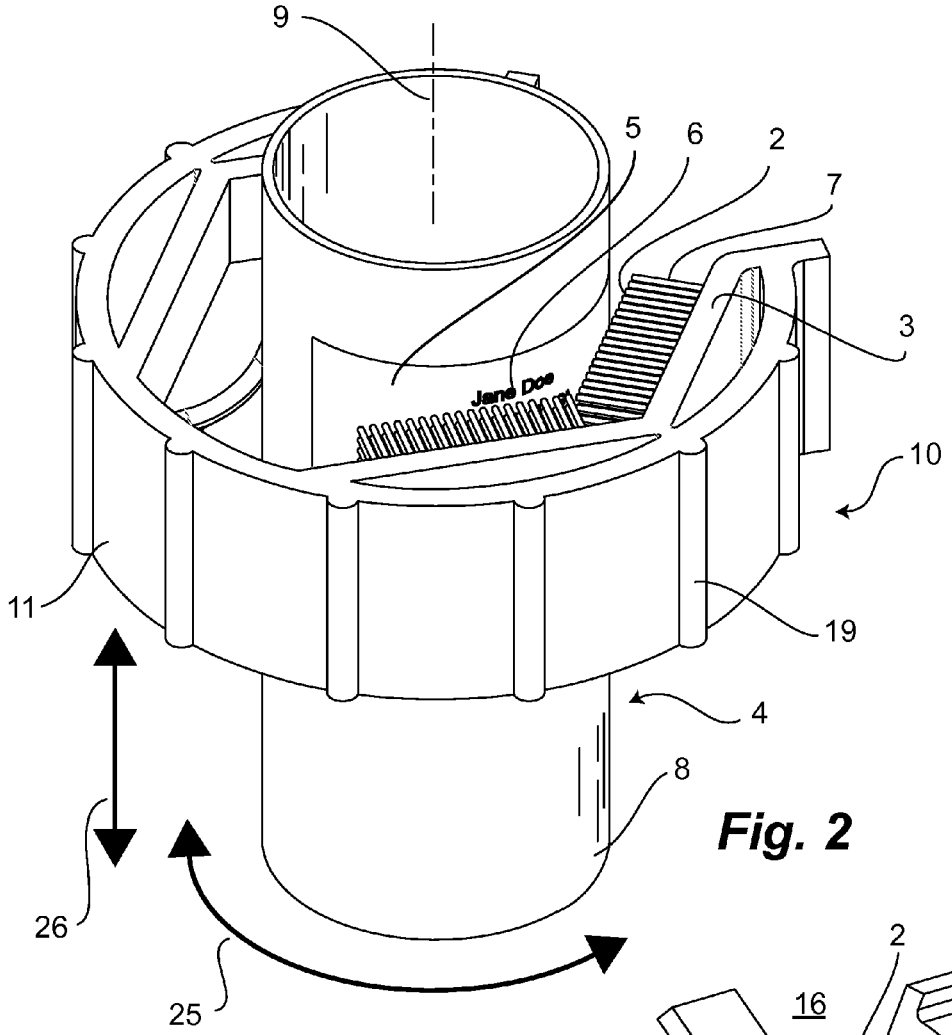
FIG. 2 is a perspective view of the preferred embodiment, showing a prescription label with printed information.
Figure 3:
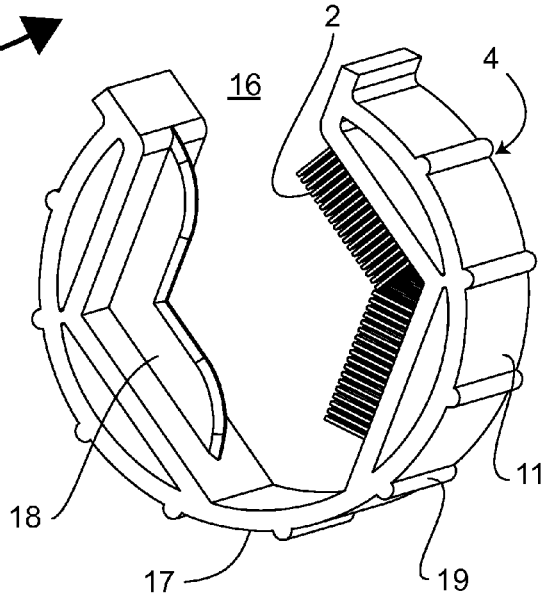
FIG. 3 is a perspective view of the preferred embodiment, showing tangential contact surfaces.
Figure 5:
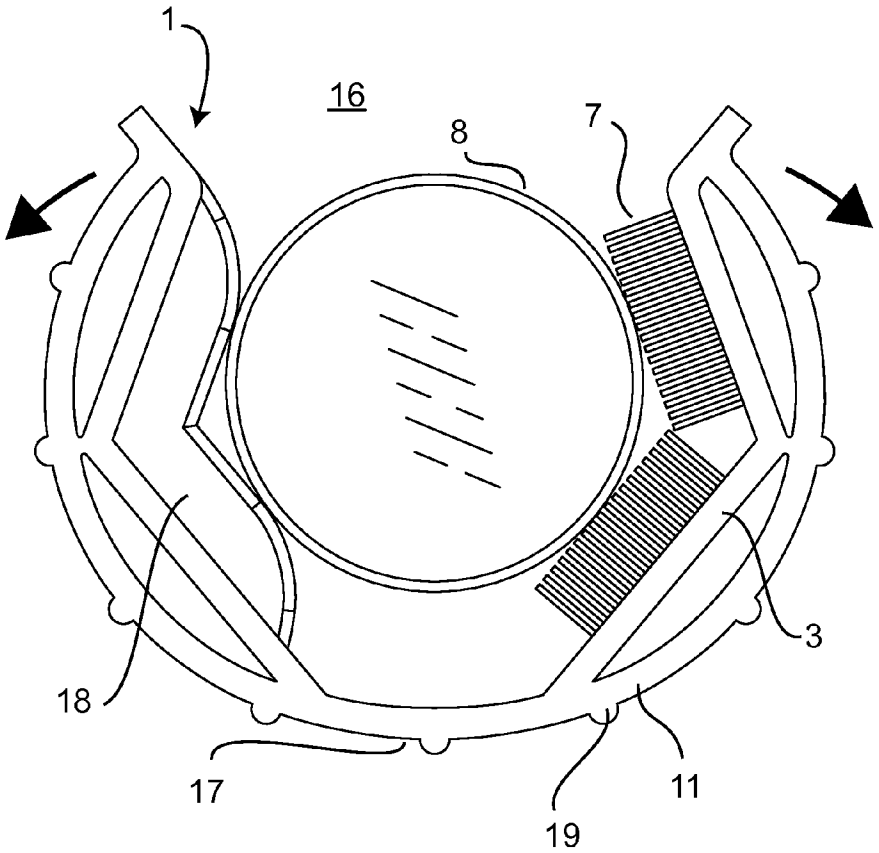
FIG. 5 is a plan view of the preferred embodiment, showing adaptation to larger vials by spreading.
Figure 4:
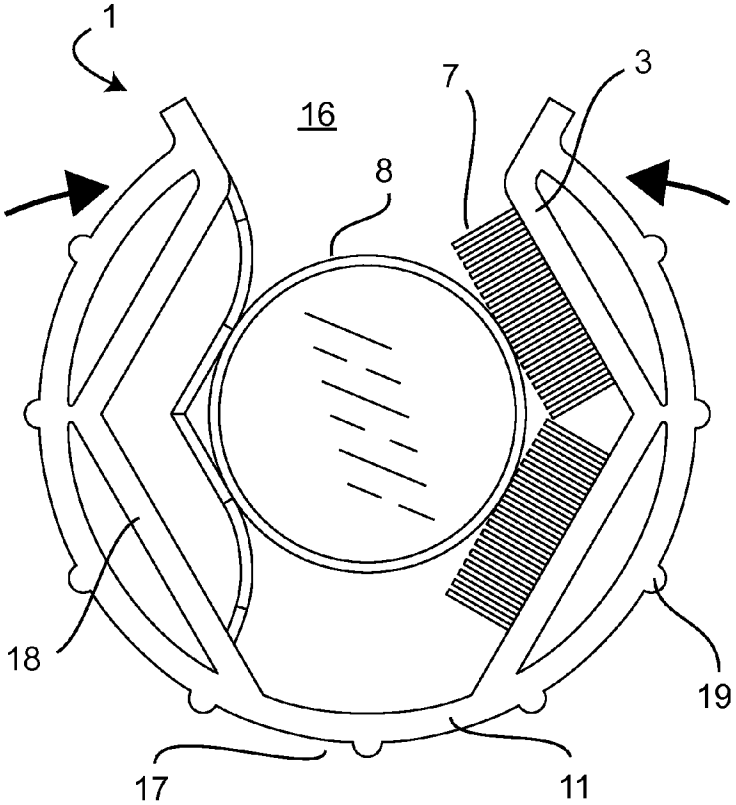
FIG. 4 is a plan view of the preferred embodiment, showing adaptation to smaller vials by squeezing.

As best shown in FIGS. 1 and 2, a device 1 for removing printed information 6 from a prescription label 5 on a container 4 comprises an abrasive surface 2 on a support member 3 and a pressure application means 10 capable of hand application. The prescription label 5 may have printed on it personal medical information, which can be rendered unreadable from the prescription label 5 by scarifying it in one or move movements of abrasive surface 2 against the prescription label 5. It is to be noted that the device 1 can be used to obliterate any information on any labeled surface, and that it is particularly useful on surfaces with a curvature.

In the preferred embodiment, the container 4 is a prescription bottle 8 and the abrasive surface 2 is wire bristles 7 embedded in the support member 3. The prescription bottle 8 is the intimate container for the medication provided, and may be a pharmacist supplied vial, or may otherwise be the package put-up of a drug manufacturer. The prescription bottle 8 is generally of cylindrical shape and of plastic construction. It may be formed by injection molding or blow molding.

The wire bristles 7 may be embedded by insert molding; or, otherwise, by "stapling" a penetrable sheet to extend therefrom standing protrusions. The abrasive surface 2 may alternatively be comprised of grit, as in sandpaper, or rasp-like protrusions of generally metal construction. For purposes of the invention, the abrasive surface 2 may be any surface capable of abrading the prescription label 5, or any layer or coating covering said label.

In the preferred embodiment, the pressure application means 10 comprises a flexible collar 11, as shown in FIGS. 2-5. The flexible collar 11 circumferentially wraps the prescription bottle 8 at an axial radius providing sufficient moment arm for a preferred rotational leverage while remaining within a hand-grip span. The preferred rotational leverage is such as to maximally require a force only within the limited capability of a senior person afflicted with moderately arthritic hands. The flexible collar 11 has an open end 16 and a flex end 17 diametrically opposite the open end. The open end 16 spreads apart (FIG. 5) by means of flexion at the flex end 17 to accommodate larger diameter bottles. Alternatively, the open end 16 may be compressed (FIG. 4) by similar flexion means to accommodate smaller diameter bottles. In the preferred embodiment, the radius of the flexible collar 11 is approximately 3 cm. The flexible collar 11 may have beads 19 about the periphery thereof, as shown, or may otherwise have texturing to assist with obtaining a grip thereon.

The support member 3 is situated interiorly, and attached thereto, the flexible collar 11 between the open end 16 and flex end 17. A pressure rail 18 is positioned diametrically opposite the support member 3. The pressure rail 18 serves to keep an axis of rotation 9 (FIG. 2) centered on the prescription bottle 8. Minimal contact surfaces are desirable to reduce frictional drag. Therefore, it is preferable that both the abrasive surface 2 and the pressure rail 18 brush the bottle with tangential strokes. Accordingly, it is preferable that the abrasive surface 2 take a planar configuration and the contact edge of the pressure rail 18 be tapered to essentially a line configuration. For the abrasive part, the alternative configuration of a cylindrical section with a radius of curvature greater than that of the bottle would substantively serve the same purpose of minimizing contact. For the complementary part, the pressure rail 18 may be enhanced to serve glide purposes by alternatively configuring it with ball-bearing rollers; or otherwise by providing it with a lubricious contact surface, such as with polytraflouroethylene (PTFE).

Pressure is applied to the flexible collar 11 by taking an essentially diametral grip between the thumb and fingers of a hand and squeezing to narrow the open end 16 while forcing the label into the abrasive surface 2 through push by the pressure rail 18. Pressure is necessary and sufficient to penetrate any protective coating or covering of the label surface. The bottle 8 is meanwhile held in a grip by the other hand. In operation, the abrasive surface 2 is moved over, and into, the prescription label 5, at the location of the targeted printed information, in a scarifying action of the substrate, by motion of one or the other gripping hands in a preferred direction 24 while holding with the remaining hand. The preferred direction 24 is a rotational direction 25 (FIG. 2); or, may otherwise be a combination of the rotational direction 25 and a translational direction 26 crisscrossing over the printed information 6.

The rotational action may be assisted by a wrench-like attachment (not shown) applied to the flexible collar 11. The grip on the prescription bottle 8 may be assisted by a rubber sleeve (not shown) applied there over, or a texturized gripping sheet similar to that used for opening jar lids. The prescription label 5, if comprised of paper, may be softened by preliminarily moistening it.

The flexible collar 11, including the support member 8 and the pressure rail 18, may be injected-molded with the wire bristles 7 insert-molded within the mold cycle. Alternatively, the wire bristles 7 and the support member 8 may be assembled to the flexible collar 11 post-molding. The preferred resins are acrylonitrile butadiene styrene (ABS), high-impact polystyrene (HIPS) or any resin with toughness as a property. The wire bristles 7 are preferably constructed of stainless steel and have a flex modulus similar to that of conventional wire brushes.

Figure 9:
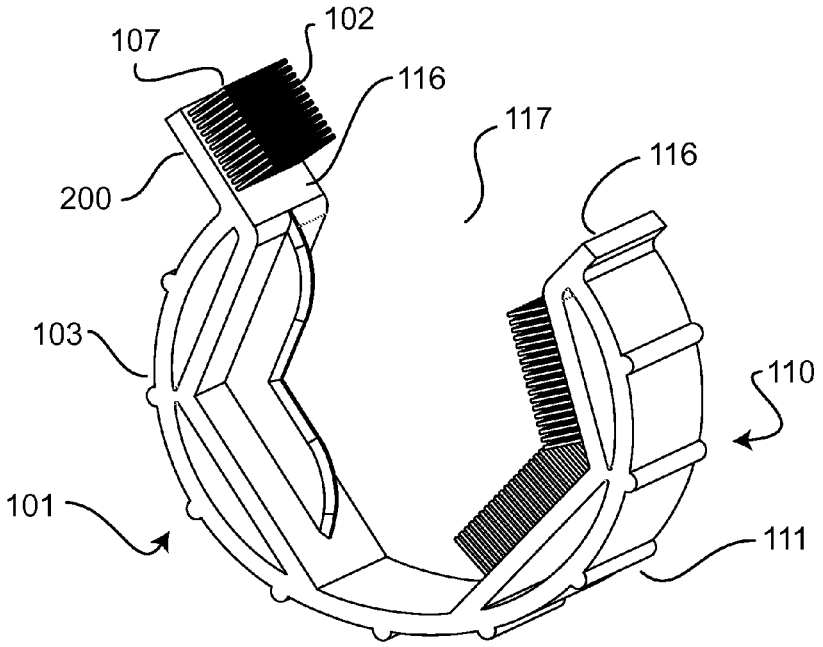
FIG. 9 is a perspective view of an alternative embodiment featuring a wing for larger size bottles.
Figure 10:
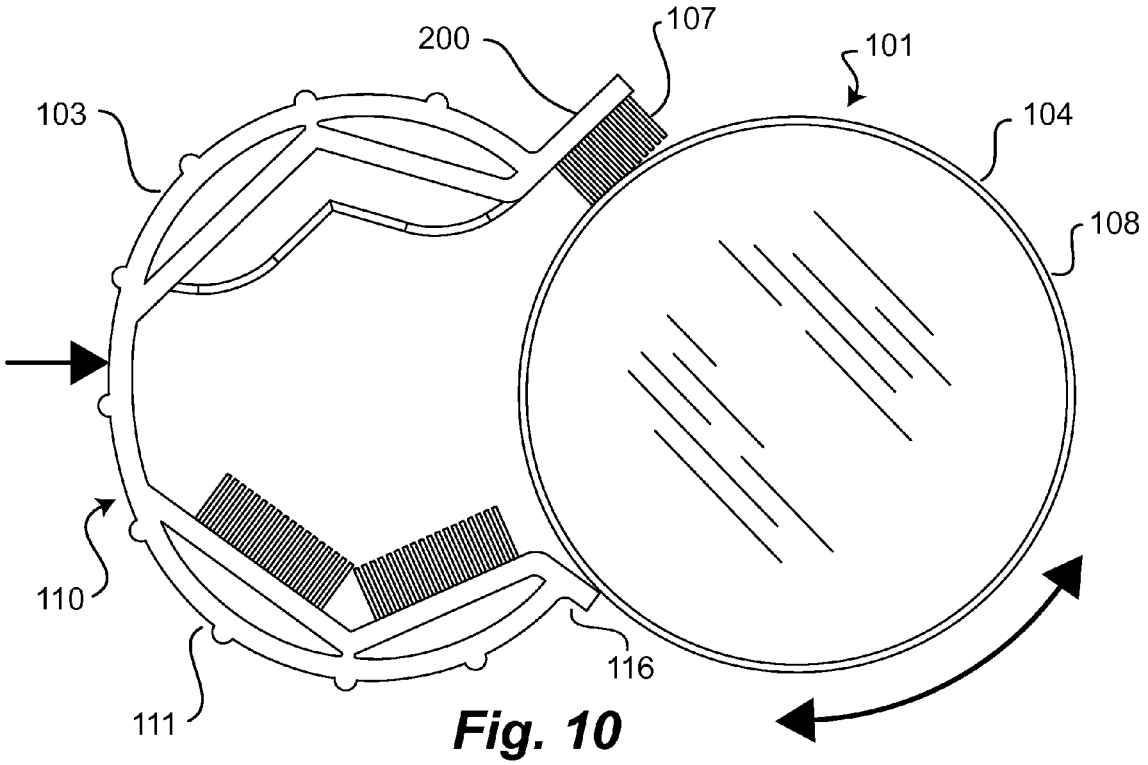
FIG. 10 is a plan view of the alternate embodiment featuring a wing, showing placement on a larger-sized bottle.

In an alternate version of the preferred embodiment, as shown in FIGS. 9 and 10, a device 101 comprises a wing member 200 extending from one of spreadable ends 116 of a support member 103, the spreadable ends 116 framing an opening 117. The wing member 200 supports an abrasive surface 102, which is preferably wire bristles 107. The wing member 200 is oriented to tangentially strike a container 104, which is preferably a prescription label bottle 108, of a diameter essentially exceeding that of the support member 103. A pressure application means 110 comprises the application of pressure to a flexible collar component 111 of the support member 103 held against the container 104 positioned in the opening 117, forcing a spreading apart of the spreadable ends 116, the spreading applying radially-directed pressure to the abrasive surface 102 by resilient action of flexible collar 111; while, at the same time, the container 104 is rotated in place to scarify printed matter thereon.

Figure 6:
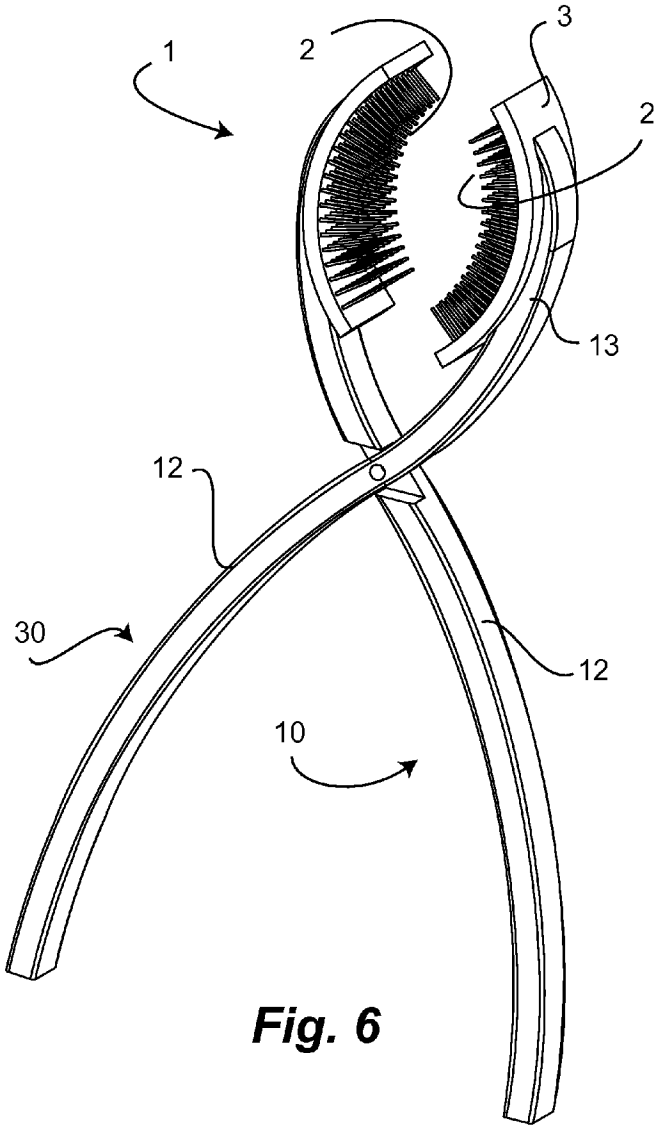
FIG. 6 is a perspective view of an alternate embodiment featuring a pliers-like handle.

In some alternate embodiments of the device 1, the pressure application means 10 further comprises at least one handle 30. The at least one handle 30 provides additional leverage for rotational manipulation, for clamping pressure or for both. In the alternative embodiment of FIG. 6, the at least one handle 30 is comprised of pliers-like levers 12. Pliers-like levers 12 are pivotally connected together to form pliers jaws 13. The pliers jaws 13 are configured to receive the prescription bottle 8 there within. The support member 3 and the abrasive surface 2 are interposed in the pliers jaws 13. Pressure may be applied by hand to the prescription label 5 by squeezing the pliers-like levers 12 to close the pliers jaws 13 about the prescription bottle 8. Movement may progress by means of the two-hand cooperative actions described above.

Figure 7:
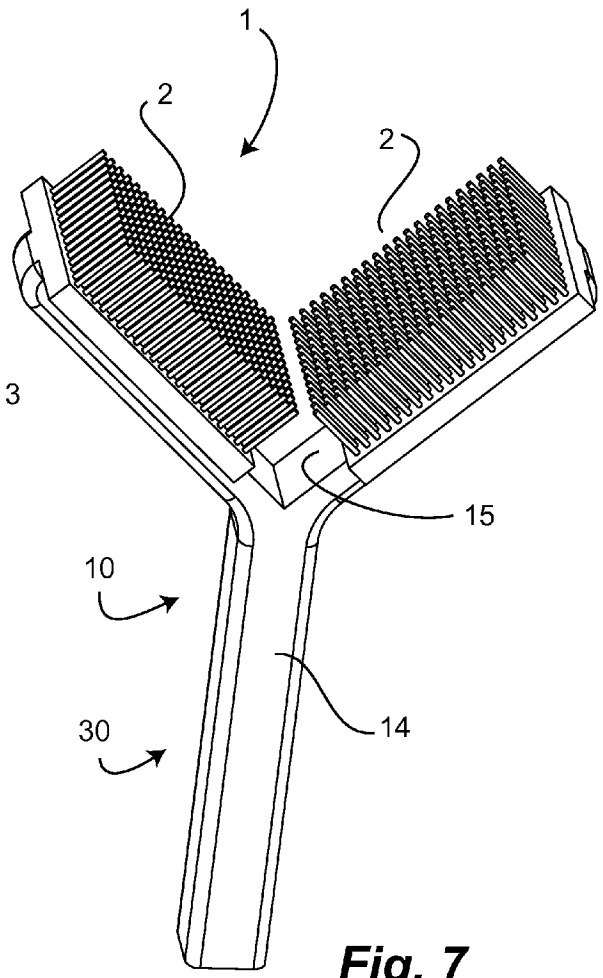
FIG. 7 is a perspective view of an alternate embodiment featuring a yoke-like handle.

In the alternative embodiment of FIG. 7, the at least one handle 30 is comprised of a yoke 14 having at least one yoke arm 15. The support member 3 and the abrasive surface 2 are disposed on the at least one yoke arm 14. Pressure may be applied by pressing the prescription bottle 8 against the yoke arm 15 while holding the yoke 14. Movement may progress by means of the two-hand cooperative actions described above.

Figure 8:
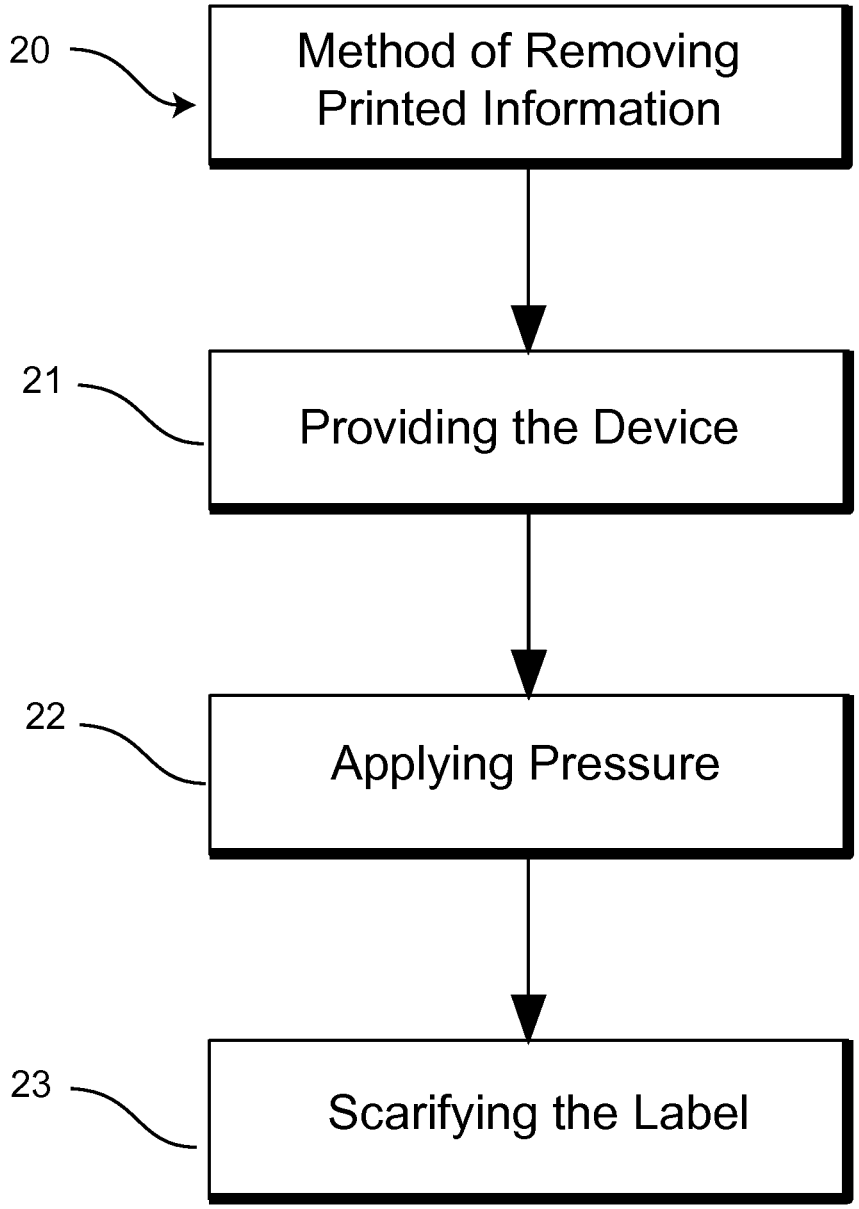
FIG. 8 is a chart of the method of an alternate embodiment.

In the alternative embodiment shown in the chart of FIG. 8, a method 20 of removing printed information 6 from a prescription label 5 on a container 4 comprises:

Step 21: Providing a device 1 comprised of an abrasive surface 2, a support member 3 for the abrasive surface 2, and a pressure application means 10 through the support member 3 to the abrasive surface 2 while moving the same against the prescription label 5;

Step 22: Applying hand pressure through the pressure application means 10; and

Step 23: Scarifying the label 5 by moving the device 1 and the container 4 relative to each other, in at least one preferred direction 24, by holding with one hand while manipulating with the other hand to render unreadable printed information 6 on the prescription label 5.

It is to be understood that the invention is not limited in its application to the details of construction, to the arrangements of the components and to the method of using set forth in the preceding description or illustrated in the drawings. For example, the wire bristles 7 may alternatively be comprised of any wire-like filaments of polymer or ceramic construction; or, the pliers-like levers 12 may be flexibly joined at one end thereof, rather than be pivotally connected. Also, it is to be understood that the phraseology and terminology employed herein are for the purpose of the description and should not be regarded as limiting.

What is claimed is:

1. A device for removing printed information from a prescription label on a container comprising:
- an abrasive surface;
- a support member for the abrasive surface;
- a pressure rail positioned opposite the support member, the pressure rail providing a first container contact surface and a second container contact surface; and
- a pressure application means for supplying hand pressure through the support member to the abrasive surface while moving the same against the prescription label;
- whereby the printed information may be obliterated by scarifying the label with the abrasive surface.

2. The device of claim 1, wherein the abrasive surface is comprised of wire bristles.

3. The device of claim 1, wherein the abrasive surface is comprised of grit.

4. The device of claim 1, wherein the abrasive surface comprises rasp-like protrusions.

5. The device of claim 1, wherein the pressure application means comprises a flexible collar rotationally disposed about the circumference of the container.

6. The device of claim 5, wherein the flexible collar can be adjusted to fit different size containers.

7. The device of claim 5, wherein the support member is radially biased toward the prescription label by squeezing the flexible collar.

8. The device of claim 5, wherein the pressure application means comprises at least one handle adapted to manipulate the device while pressing the support member against the container.

9. The device of claim 8, wherein the at least one handle comprises pliers-like levers with the support member positioned in the jaws thereof.

10. The device of claim 1, wherein the at least one handle comprises a yoke with the support member positioned on at least one of an arm thereof.

11. The device of claim 1, wherein the abrasive surface strokes the label essentially tangentially during a rotational movement there over.

12. The device of claim 5, wherein the abrasive surface is counter-posed with the pressure rail to maintain concentricity with the container, the rail having an edge configured to make minimal contact with the container.

13. The device of claim 12, wherein the pressure rail is comprised of a contact surface having glide properties.

14. The device of claim 1, wherein the pressure application means comprises a flexible collar held against the circumference of the container, the flexible collar having spreadable ends and a wing member projecting from one of the spreadable ends, the wing member supporting the abrasive surface at an angle to tangentially strike the container when the container is forced by hand into an opening between the spreadable ends.

15. A device for removing printed information from a prescription label on a prescription bottle comprising:
- an abrasive surface;
- a support member for the abrasive surface;
- a pressure rail positioned opposite the support member, the pressure rail providing a first container contact surface and a second container contact surface; and
- a C-shaped flexible collar surrounding the prescription label on the prescription bottle and holding the support member and pressure rail against said bottle by compression force;
- whereby the printed information may be obliterated by scarifying the label with the abrasive surface under pressure applied by the compression force.

16. The device of claim 15, wherein the abrasive surface is counter-posed with a pressure rail to maintain concentricity with the bottle, the rail having an edge configured to make minimal contact with the bottle.

17. The device of claim 15, wherein the abrasive surface is comprised of wire bristles.

18. A method of removing printed information from a prescription label on a container comprising the steps of:

providing a device comprised of an abrasive surface, a support member for the abrasive surface, a pressure rail positioned opposite the support member, the pressure rail providing a first container contact surface and a second container contact surface, and a pressure application means through the support member to the abrasive surface while moving the same against the prescription label;

applying hand pressure through the pressure application means; and scarifying the label by moving the device and the container relative to each other, in at least one preferred direction, by holding with one hand while manipulating with the other hand;

whereby, selected printed information on the prescription label may be rendered unreadable in the scarifying step.

19. The method of claim 18, wherein the pressure application means comprises a flexible collar rotationally disposed about the circumference of the container.

20. The method of claim 18, wherein the at least one preferred direction comprises at least two crisscrossing directions.

* * * * *